US005408943A

United States Patent [19]

Vatsky

[11] Patent Number: 5,408,943

[45] Date of Patent: * Apr. 25, 1995

[54] SPLIT STREAM BURNER ASSEMBLY

[75] Inventor: Joel Vatsky, West Orange, N.J.

[73] Assignee: Foster Wheeler Energy Corporation, Clinton, N.J.

[ * ] Notice: The portion of the term of this patent subsequent to Sep. 20, 2011 has been disclaimed.

[21] Appl. No.: 114,549

[22] Filed: Aug. 31, 1993

Related U.S. Application Data

[63] Continuation of Ser. No. 826,557, Jan. 27, 1992, abandoned.

[51] Int. Cl.[6] ..... F23D 1/02

[52] U.S. Cl. ..... 110/261; 110/264; 431/188; 431/186

[58] Field of Search ..... 431/8, 12, 173, 182, 431/184, 187, 188, 186, 189; 110/261, 263, 264, 265; 239/418, 403, 424.5, 553.5

[56] References Cited

U.S. PATENT DOCUMENTS

| | | | |
|---|---|---|---|
| 3,897,199 | 7/1975 | Grozegno et al. . | |
| 3,944,142 | 3/1976 | Welden et al. . | |
| 4,043,512 | 8/1977 | Trozzi . | |
| 4,116,388 | 9/1978 | Trozzi . | |
| 4,223,615 | 9/1980 | Breen et al. . | |
| 4,348,170 | 9/1982 | Vatsky et al. . | |
| 4,400,151 | 8/1983 | Vatsky . | |
| 4,412,496 | 11/1983 | Trozzi . | |
| 4,421,039 | 12/1983 | Llinares, Jr. . | |
| 4,443,182 | 4/1984 | Wojcieson et al. . | |
| 5,090,339 | 2/1992 | Okiura et al. | 110/265 X |

FOREIGN PATENT DOCUMENTS

| | | | |
|---|---|---|---|
| 1007931 | 5/1957 | Germany | 110/263 |
| 0159741 | 12/1979 | Japan | 110/264 |
| 0159743 | 12/1979 | Japan | 110/264 |
| 0202402 | 12/1982 | Japan | 110/265 |
| 136320 | 1/1930 | Switzerland | 110/264 |
| 325057 | 2/1930 | United Kingdom | 110/261 |
| 775730 | 5/1957 | United Kingdom | 110/264 |
| 140938 | 5/1960 | U.S.S.R. | 110/261 |

*Primary Examiner*—Carl D. Price
*Attorney, Agent, or Firm*—Marvin A. Naigur

[57] ABSTRACT

A burner assembly in which an annular passage is provided for transporting an fuel/air mixture to a furnace inlet. A conical divider member is disposed within the annular passage for dividing the stream of fuel/air passing through the passage into two radially-spaced coaxial, passages. A plurality of angularly-spaced walls are disposed within one of said passages for dividing the latter passage into a plurality of segments for splitting up fuel/air stream so that, upon ignition of said fuel, a plurality of flame patterns are formed. Ribs are provided on one of the surfaces defining the other passage to concentrate the fuel portion of the mixture flowing through said latter passage to form an additional flame pattern which is surrounded by the above-mentioned plurality of flame patterns.

12 Claims, 3 Drawing Sheets

SPLIT STREAM BURNER ASSEMBLY

This is a continuation of application Ser. No. 07/826,557, filed on Jan. 27, 1992, now abandoned.

BACKGROUND OF THE INVENTION

This invention relates generally to a burner assembly and, more particularly, to an improved burner assembly which operates in a manner to reduce the formation of nitrogen oxides as a result of fuel combustion.

In a typical arrangement for burning coal in a furnace section of a reactor, vapor generator, or the like, several burners are disposed in communication with the interior of the furnace and operate to burn a mixture of air and pulvarized coal. The burners used in these arrangements are generally of the type in which a fuel/air mixture is continuously injected through a nozzle so as to form a single relatively large flame. As a result, the surface area of the flame is relatively small in comparison to its volume, and therefore the average flame temperature is relatively high. However, when the fuel portion of the fuel/air mixture is in its form of pulverized coal, nitrogen oxides are formed by the fixation of atmospheric nitrogen available in the combustion supporting air, which is a function of the flame temperature. When the flame temperature exceeds 2800° F., the amount of fixed nitrogen removed from the combustion supporting air rises exponentially with increases in the temperature. This condition leads to the production of high levels of nitrogen oxides in the final combustion products, which cause severe air pollution problems. Nitrogen oxides are also formed from the nitrogen available in the coal itself, which is not a direct function of the flame temperature, but is related to the quantity of available oxygen during the combustion process.

In view of the foregoing, attempts have been made to suppress the flame temperatures and reduce the quantity of available oxygen during the combustion process and thus reduce the formation of nitrogen oxides. Attempted solutions have included techniques involving two stage combustion, flue gas recirculation, the introduction of an oxygen-deficient fuel/air mixture to the burner, and the breaking up of a single large flame into a plurality of smaller flames. However, although these attempts singularly may produce some beneficial results, and in some cases yield significant NOx reductions, further reductions of nitrogen oxides are obtainable.

SUMMARY OF THE INVENTION

It is therefore an object of the present invention to provide a burner assembly which operates in a manner to considerably reduce the production of nitrogen oxides in the combustion of fuel.

It is a further object of the present invention to provide a burner assembly in which the surface area of the flame per unit volume is increased which results in a greater flame radiation, a lower flame temperature, and a shorter residence time of the combustion constituents within the flame at maximum temperature.

It is a still further object of the present invention to provide a burner assembly of the above type in which the stoichiometric combustion of the fuel is regulated to reduce the quantity of available oxygen during the combustion process and achieve an attendant reduction in the formation of nitrogen oxides.

A more specific object of the present invention is to provide a burner assembly of the above type in which secondary air is directed towards the burner outlet in two parallel paths with register means being disposed in each path for individually controlling the flow and swirl of air through each path.

Another more specific object of the present invention is to provide a burner assembly of the above type in which the fuel/air mixture is passed through two radially-spaced, parallel annular passages.

A still further object of the present invention is to provide a burner assembly of the above type in which the fuel portion in one of the passages is concentrated to form a single flame pattern.

A still further object of the present invention is to provide a burner assembly of the above type in which the other passage is divided into a plurality of angularly-spaced passages to form a plurality of flame patterns that surround the single flame pattern.

Toward the fulfillment of these and other objects, the burner assembly of the present invention includes an annular passage having an inlet located at one end thereof for receiving a fuel/air mixture, and an outlet located at the other end of the passage for discharging the mixture. A conical dividing member is disposed within the annular passage for dividing the passage into two radially spaced passages. The outer passage is divided into a plurality of angularly-spaced segments for splitting up the fuel/air mixture so that, upon ignition of the fuel, a plurality of flame patterns are formed. Ribs are provided on the inner surface defining the other inner passage, which concentrate the fuel discharging from the passage to form another flame pattern which is surrounded by the plurality of flame patterns. Secondary air is directed towards the outlet in two parallel paths extending around the burner, and a plurality of register vanes are disposed in each of the paths for regulating the quantity and swirl of the air flowing through the paths.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENTS

Figure 1:
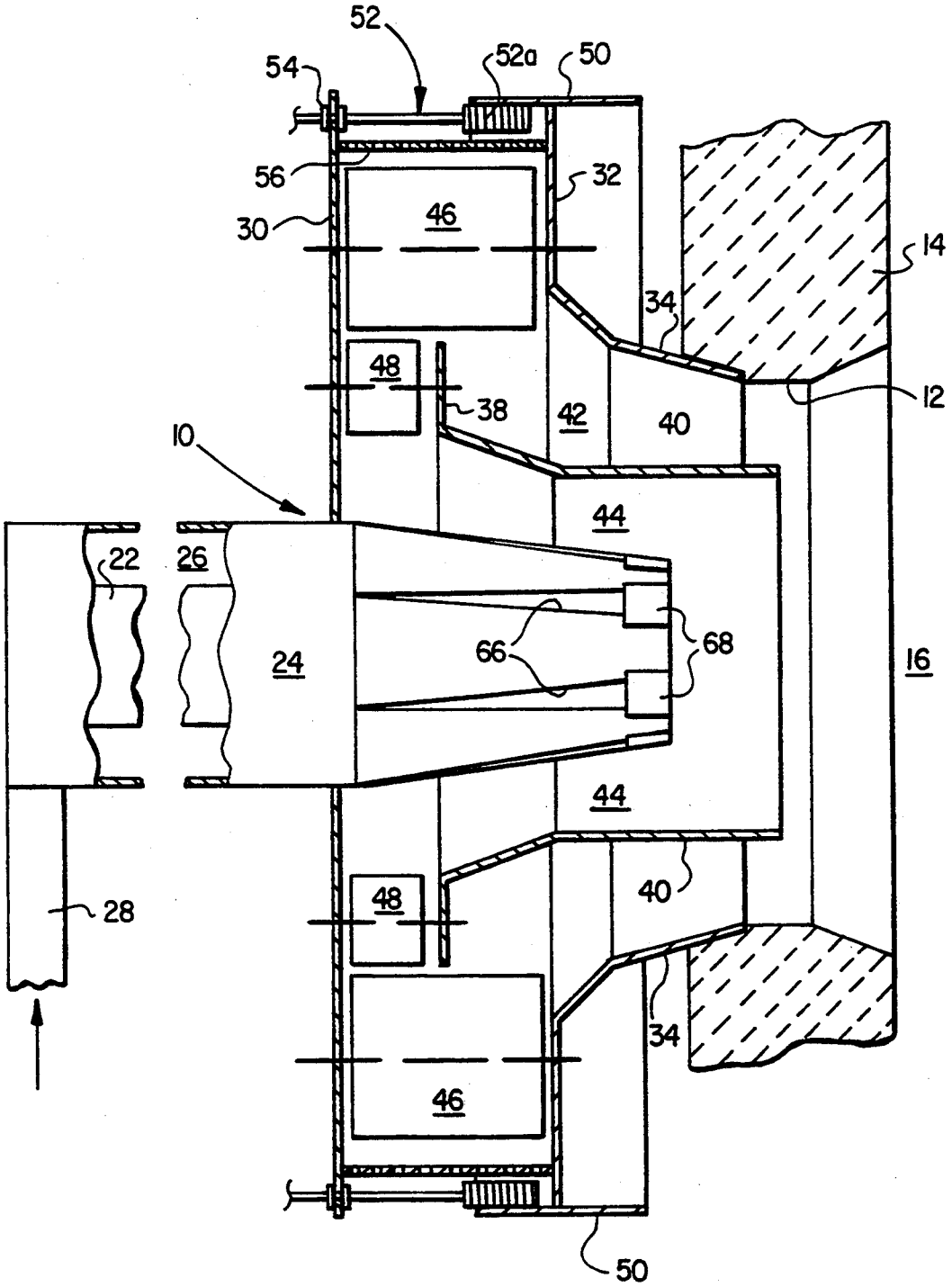
FIG. 1 is a sectional view depicting the burner assembly of the present invention installed adjacent a furnace opening.

Referring specifically to FIG. 1 of the drawings, the reference numeral 10 refers in general to a burner assembly which is disposed in axial alignment with a through opening 12 formed in a front or rear wall 14 of a conventional furnace. It is understood that the furnace includes a rear wall and side walls of an appropriate configuration to define a combustion chamber 16 immediately adjacent the opening 12. Also, similar openings are provided in the furnace front or rear walls 14 for accommodating additional burner assemblies identical to the burner assembly 10. The inner surface of the wall 14 as well as the other walls of the furnace are lined within an appropriate thermal insulation material and, while not specifically shown, it is understood that the combustion chamber 16 can also be lined with boiler tubes through which a heat exchange fluid, such as water, is circulated in a conventional manner for the purposes of producing steam.

It is also understood that a vertical wall is disposed in a parallel relationship with the furnace wall 14 along with connecting top, bottom, and side walls to form a plenum chamber, or windbox, for receiving combustion supporting air, commonly referred to as "secondary air" in a conventional manner.

The burner assembly 10 includes an inner tubular member 22 and an outer tubular member 24. The outer member 24 extends over the inner member 22 in a coaxial, spaced relationship thereto to define an annular passage 26 which extends to the furnace opening 12. A tangentially disposed inlet duct 28 communicates with the outer tubular member 24 for introducing a mixture of fuel and air into the annular passage 26 as will be explained in further detail later.

A pair of spaced annular plates 30 and 32 extend around the nozzle 20, with the inner edge of the plate 30 terminating on the outer tubular member 24. A liner member 34 extends from the inner edge of the plate 32 and in a general longitudinal direction relative to the nozzle 20 and terminates just inside the wall 14. An additional annular plate 38 extends around the nozzle 20 in a spaced, parallel relation with the plate 30. An air divider sleeve 40 extends from the inner surface of the plate 38 and between the liner 34 and the nozzle 20 in a substantially parallel relation to the nozzle and the liner 34 to define two air flow passages 42 and 44.

A plurality of outer register vanes 46 are pivotally mounted between the plates 30 and 32 to control the swirl of secondary air from the above-mentioned windbox to the air flow passages 42 and 44. In a similar manner a plurality of inner register vanes 48 are pivotally mounted between the plates 30 and 38 to further regulate the swirl of the secondary air passing through the annular passage 44. It is understood that although only two register vanes 46 and 48 are shown in FIG. 1, several more vanes extend in a circumferentially spaced relation to the vanes shown. Also, the pivotal mounting of the vanes 46 and 48 may be done in any conventional manner, such as by mounting the vanes on shafts (shown schematically) and journalling the shafts in proper bearings formed in the plates 30, 32 and 38. Also, the position of the vanes 46 and 48 may be adjustable by means of cranks or the like. Since these types of components are conventional they are not shown in the drawings nor will be described in any further detail.

The quantity of air flow from the windbox into the vanes 46 is controlled by movement of a sleeve 50 which is slidably disposed on the outer periphery of the plate 32 and is movable parallel to the longitudinal axis of the nozzle 20. An elongated worm gear 52 is provided for moving the sleeve 50 and extends through a bushing 54 which is attached to the plate 30 to provide rotatable support. The worm gear 52 has one end portion suitably connected to an appropriate drive means (not shown) for rotating the worm gear and the other end provided with threads **52*a*. The threads 52*a* of the worm gear 52 mesh with appropriate apertures (not shown) formed in the sleeve 50 so that, upon rotation of the worm gear, the sleeve moves longitudinally with respect to the longitudinal axis of the nozzle 20 and across the air inlet defined by the plates 30 and 32. In this manner, the quantity of combustion supporting air from the windbox passing through the air flow passages 42 and 44 can be controlled by axial displacement of the sleeve 50. A perforated air hood 56 extends between the plates 30 and 32 immediately downstream of the sleeve 50** to permit independent measurement of the secondary air flow to the burner by means of static pressure differential measurements. This is a conventional means of measuring flow and the measuring apparatus is not shown. Further details of this register assembly are shown and described in U.S. Pat. No. 4,348,170 and U.S. Pat. No. 4,400,151 assigned to the assignee of the present invention, the disclosures of which are incorporated by reference.

Figure 2:
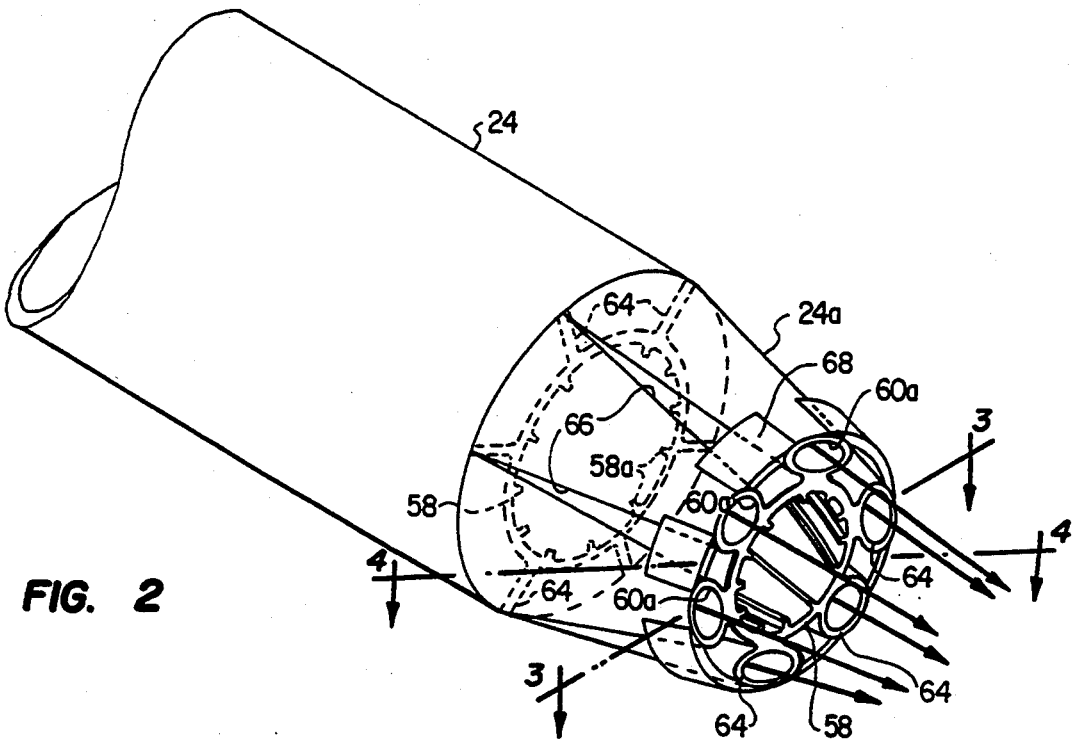
FIG. 2 is a partial perspective view of a portion of the burner assembly of FIG. 1.
Figure 3:
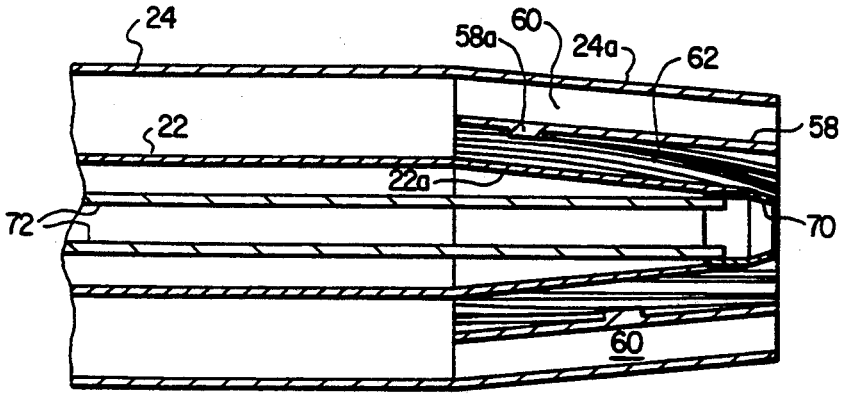
FIGS. 3 and 4 are sectional views taken along the line 3—3 and 4—4, respectively, of FIG. 2.
Figure 4:
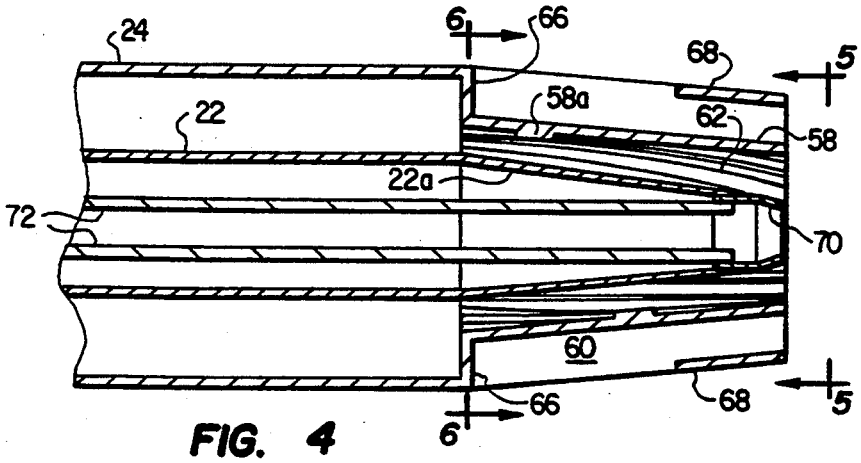

FIGS. 2–4 depict the details of the burner assembly 20. As shown, the end portions, or tips, of the inner and outer tubular members 22 and 24 are tapered slightly radially inwardly toward the furnace opening 12 as shown by the reference numerals **22*a* and 24*a*, respectively. A divider cone 58 extends between the tips 22*a* and 24*a* to define two radially-spaced, parallel, coaxial passages 60 and 62. The outer passage 60 extends between the tip of the outer barrel member 24 and the divider cone 58 and the inner passage 62 extends between the divider cone 58 and the tip of the inner tubular member 22. One end of each passage 60 and 62 receives the fuel/air mixture from the annular passage 26 and the other end of each passage 60 and 62 discharges the mixture into the furnace opening 12** in a manner to be described.

Figure 5:
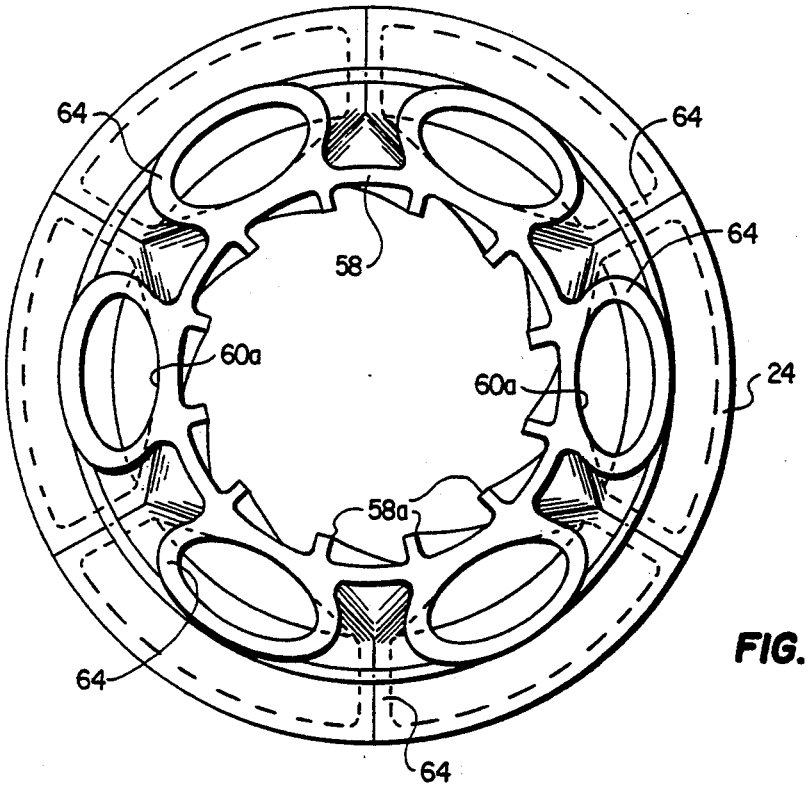
FIGS. 5 and 6 are enlarged elevational views of the respective ends of the burner assembly of FIG. 1.
Figure 6:
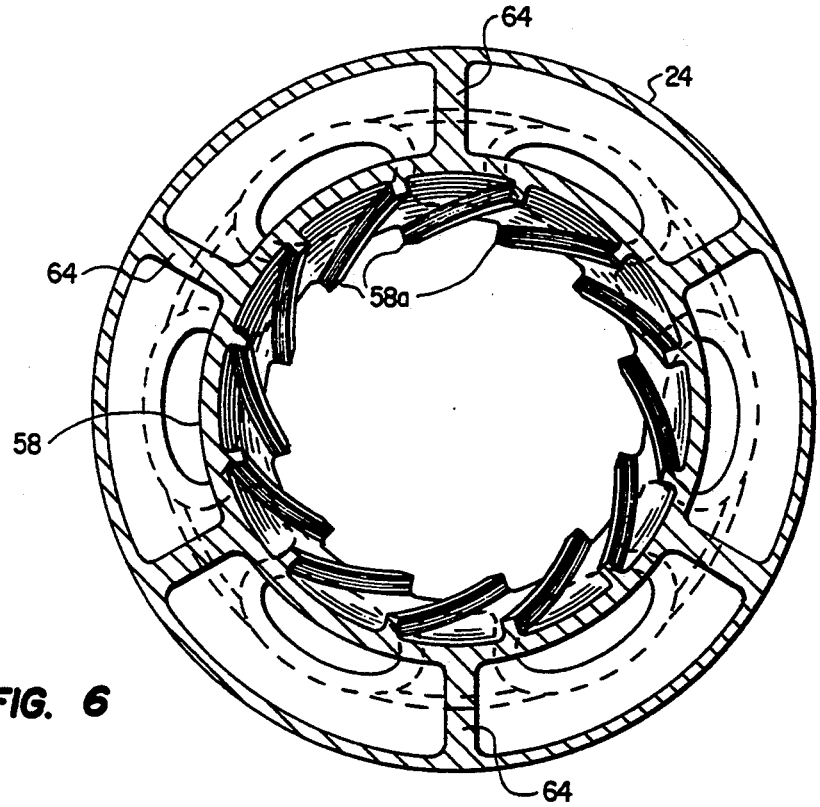

As better shown in FIGS. 2, 5 and 6 the outer annular passage 60 is divided into six segments **60*a*, angularly spaced at sixty degree intervals. Each segment 60*a* is formed by moulding a plurality of elliptical-shaped (in cross-section) walls 64 in the passage 60 which, together with the corresponding surface of the outer tubular member 24 and the divider cone 58, define enclosed passages for passing the fuel/air mixture. Each wall 64 extends for the complete length of the annular passage 60 and tapers inwardly towards the discharge end of the passage. Thus the elliptical outlet opening of each segment 60*a*, as better shown in FIG. 5, is smaller than the inlet opening thereof, as better shown in FIG. 6. The outlet opening of each segment 60*a* may be elliptical, as shown in FIGS. 2, 5 and 6**, but may be of other geometry such as circular, rectangular or square.

As better shown in FIG. 1, six angularly-spaced wedge-shaped openings 66 are formed between adjacent walls 64 for admitting secondary air from the inner air flow passage 44 (FIG. 1) into the portion of the outer passage 60 not occupied by the angularly-spaced segments **60*a*. Six plates 68 extend over the end portion of each opening 66 at the discharge end portion of the nozzle assembly 10**.

As better shown in FIGS. 5 and 6, a plurality of ribs **58*a* are formed on the inner surface of the divider cone 58 to collect the solid fuel particles as the mixture of air and fuel particles pass through the annular chamber 62, and thus concentrate the fuel particles before they are discharged into the furnace opening 12**.

As shown in FIGS. 3 and 4, a tip 70 is formed on the end of the tapered portion **22*a* of the inner tubular member 22, and is movable relative to the member 22 by means of a plurality of rods 72** extending within the member 22 and affixed to the inner wall of the tip. The other ends of the rods 72 can be connected to any type of actuator device (not shown) such as a hydraulic cylinder or the like to effect longitudinal movement of the rods and therefore the tip 70 in a conventional manner. Thus longitudinal movement of the tip 70 varies the effective outlet opening of the inner annular passage 62 so that the amount of fuel/air flowing through this opening, and therefore the relative area between the passages 60 and 62, can be regulated, thereby varying the total area of passages 60 and 62. Extending the tip 70 towards the furnace opening 12 will decrease the free area in passage 62 thereby decreasing the total free area of passages 60 and 62. Consequently, the velocity of the coal/air mixture exiting passage 60 and 62 will increase when the flow is constant.

It is understood that appropriate igniters can be provided adjacent the outlet of the nozzle 20 for igniting the coal as it discharges from the nozzle. Since these ignitors are of a conventional design they have not been shown in the drawings in the interest of clarity.

In operation, the movable sleeve 50 (FIG. 1) associated with each burner assembly 10 is adjusted during initial start up to accurately balance the air to each burner assembly. After the initial balancing, further movement of the sleeves 50 is needed only to control the secondary air flow to the burner assembly during start-up or shut-down of the burner. However, if desired, flow control can be accomplished by the outer vanes 46.

Secondary air from the windbox is admitted through the perforated hood 56 and into the inlet between the plates 30 and 32. The axial and radial velocities of the air are controlled by the register vanes 46 and 48 as the air passes through the air flow passages 42 and 44 and into the furnace opening 12 for mixing with the coal discharged from the burner assembly 10 in a manner to be described.

Fuel, preferably in the form of pulvarized coal suspended or entrained within a source of primary air, is introduced into the tangential inlet 28 of each burner assembly 10 where it swirls through the annular chamber 26. Since the pulverized coal introduced into the inlet 28 is heavier than the air, the pulverized coal will tend to move radially outwardly towards the inner wall of the outer tubular member 24 under the centrifugal forces thus produced. As a result, a majority of the coal, along with a relatively small portion of air, enters the outer annular passage 60 (FIGS. 3 and 4) defined between the outer barrel member 24 and the divider cone 58. The inlet end portions of the segments 60*a* of the passage 60 defined by the walls 24, the outer barrel member 24 and the divider cone 58 split the stream of fuel/air into six equally spaced streams which pass through the enclosed segments 60*a* and discharge from the outlet end portions of the segments 60*a* and, upon ignition, form six separate flame patterns.

The remaining portion of the fuel/air mixture passing through the annular passage 26 enters the inner annular passage 62 defined between the divider cone 58 and the inner tubular member 22. The mixture entering passage 62 is mostly air due to the movement of the coal particles radially outwardly, as described above. The ribs 58*a* on the inner surface of the divider cone 58 collect, and therefore concentrate, the coal particles so that, upon discharge from the outlet end of the passage 62 there is sufficient coal concentration to form a seventh flame pattern which is surrounded by the six angularly-spaced flame patterns from the passage 60.

The position of the movable tip 70 can be adjusted to precisely control the relative amount, and therefore velocity, of the fuel/air mixture discharging from the annular passages 60 and 62. Secondary air from the inner air passage 44 (FIG. 1) passes through the wedge shaped openings 66 formed between its segments 60*a* and enters the outer annular passage 60 to supply secondary air to the fuel/air mixture discharging from the passages 60 and 62. The igniters are then shut off after steady state combustion has been achieved.

As a result of the foregoing, several advantages result. For example, the formation of multiple (in the example shown and described, six) flame patterns from the passage 60 which surround one independent flame pattern from the passage 62 results in a greater flame radiation, a lower average flame temperature and a shorter residence time of the gas components within the flame at a maximum temperature, all of which contribute to reduce the formation of nitric oxides.

Also, the openings 66 between the passage segments 60*a* enables a portion of the secondary air to be introduced to fuel/air stream passing through the outer annular passage 60. As a result, a substantially uniform fuel/air ratio across the entire cross-section of the air-coal stream is achieved. Also, the provision of the movable tip 70 to regulate the area of the inner annular passage 62 enables the fuel/air velocity through both passages 60 and 62 to be regulated thereby optimizing the primary air velocity with respect to the secondary air velocity.

Also, since the pressure drop across the perforated air hoods 56 associated with the burner assemblies can be equalized by balancing the secondary air flow to each burner assembly by initially adjusting the sleeves 50, a substantially uniform flue gas distribution can be obtained across the furnace. This also permits a common windbox to be used and enables the unit to operate at lower excess air with significant reductions in both nitrogen oxides and carbon monoxides. Further, the provision of separate register vanes 46 and 48 for the outer and inner air flow passages 42 and 44 enables secondary air distribution and flame shape to be independently controlled resulting in a significant reduction of nitrogen oxides, and a more gradual mixing of the primary air coal stream with the secondary air since both streams enter the furnace on parallel paths with controlled mixing.

It is understood that several variations and additions may be made to the foregoing within the scope of the invention. For example, since the arrangement of the present invention permits the admission of air at less than stoichiometric, overfire air ports, or the like can be provided as needed to supply air to complete the combustion. Also the present invention is not limited to six passage segments 60*a* which form six flame patterns at their outlets, since the number can vary in accordance with particular design requirements. Also, the outlet shape of the segments 60*a* need not be elliptical, but may be of other geometrics or particular design as fabrication requirements may dictate.

As will be apparent to those skilled in the art, other changes and modifications may be made to the embodiments of the present invention without departing from the scope of the present invention as defined in the appended claims.

What is claimed is:

1. A burner assembly for burning a particulate fuel, comprising a housing, means in said housing for defining an annular passage and a plurality of discrete passages radially spaced from the axis of said annular passage and angularly spaced around said axis, said annular passage and each of said discrete passages having an inlet for receiving a portion of the particles of fuel and an outlet for discharging said particles, the cross-sectional area of each of said discrete passages gradually decreasing from its inlet to its outlet, and means for introducing said particles into said housing in a manner so that a first portion of said particles enters said discrete passages and a second portion of said particles enters said annular passage whereby, upon discharging from said outlets of said discrete passages, said first portion of said particles form discrete flame patterns upon ignition, said passage defining means including a plurality of ribs for concentrating said second portion of said particles in said annular passage in a manner to form an additional flame pattern upon discharge from said outlet of said annular passage and ignition.

2. The burner assembly of claim 1 wherein said discrete passages and said annular passage are formed as a molded unit.

3. The burner assembly of claim 1 wherein the outlets of said discrete passages extend flush with the outlet of said annular passage.

4. The burner assembly of claim 1 wherein portions of said discrete passages are spaced apart and further comprising means for introducing air into the spaces between said discrete passages for discharging with said first portion of particles.

5. The burner assembly of claim 1 wherein said discrete passages are spaced radially outwardly from said annular passage.

6. The burner assembly of claim 1 wherein said discrete flame patterns are angularly spaced around the axis of said annular passage and wherein said additional flame pattern is surrounded by said discrete flame patterns.

7. The burner assembly of claim 1 wherein the cross-sectional area of each of said discrete passages gradually decreases from its inlet to its outlet.

8. The assembly of claim 1 wherein said discrete passage extend for the entire length of said annular passage.

9. The burner assembly of claim 1 wherein said discrete passages extend from a point between the respective ends of said housing.

10. The burner assembly of claim 1 wherein said passage-defining means comprises an inner tubular member, and an outer tubular member extending around said inner tubular member in coaxial relation thereto.

11. The burner assembly of claim 10 wherein said passage-defining means further comprises a conical divider member extending between said inner tubular member and said outer tubular member.

12. The burner assembly of claim 11 wherein said ribs are formed on the inner surface of said conical divider member.

* * * * *